US006168560B1

(12) United States Patent
Pluymaekers et al.

(10) Patent No.: US 6,168,560 B1
(45) Date of Patent: Jan. 2, 2001

(54) CUSHIONING CONVERSION MACHINE AND METHOD WITH PAD TRANSFERRING DEVICE

(75) Inventors: Serge H. L. C. Pluymaekers, Margraten; Mike J. Timmers, Landgraaf; Pierre H. G. Kobben, Kerkrade, all of (NL)

(73) Assignee: Ranpak Corp, Painesville, OH (US)

( * ) Notice: Under 35 U.S.C. 154(b), the term of this patent shall be extended for 0 days.

(21) Appl. No.: 09/293,315

(22) Filed: Apr. 16, 1999

Related U.S. Application Data

(60) Provisional application No. 60/082,124, filed on Apr. 17, 1998.

(51) Int. Cl.[7] ..... B31F 7/00

(52) U.S. Cl. ..... 493/359; 493/464; 493/340; 493/967

(58) Field of Search ..... 493/359, 464, 493/957, 340, 967; 406/28, 12, 10, 86; 198/339.1, 460

(56) References Cited

U.S. PATENT DOCUMENTS 4,237,776 * 12/1980 Ottaviano ..... 493/464
4,717,613 * 1/1988 Ottaviano ..... 493/464
5,292,238 * 3/1994 Michalak ..... 198/460
5,322,477 * 6/1994 Armington et al. ..... 493/967
5,487,717 * 1/1996 Tekavec et al. ..... 493/464
5,634,636 * 6/1997 Jackson et al. ..... 406/86
5,902,223 * 5/1999 Simmons ..... 493/464
5,989,176 * 11/1999 Ratzel et al. ..... 493/464

* cited by examiner

*Primary Examiner*—Stephen F. Gerrity
*Assistant Examiner*—Sam Tawfik
(74) *Attorney, Agent, or Firm*—Renner, Otto, Boisselle & Sklar LLP

(57) ABSTRACT

A cushioning conversion machine (20) including a converting assembly (52, 54) which converts a sheet-like stock material (22) into a strip (31) having at least one pillow-like portion (33) and another portion (34), and a severing assembly (56) which severs the leading section of the strip (31) to form a cushioning pad (32). The cushioning conversion machine 20 is characterized by a pad-transferring device (300, 400, 500, 600, 700) which transfers the cushioning pad (32) away from the severing assembly (56) by applying a transferring force to the cushioning pad (32) that is concentrated at the other portion (34) of the cushioning pad (32). The other portion (34) of the cushioning pad is preferably a compressed portion, a connecting portion which maintains the geometry of the pillow-like portion, and/or a central portion.

30 Claims, 9 Drawing Sheets

CUSHIONING CONVERSION MACHINE AND METHOD WITH PAD TRANSFERRING DEVICE

RELATED INVENTIONS

The present invention claims the benefit of U.S. Provisional Application Ser. No. 60/082,124, filed Apr. 17, 1998.

FIELD OF THE INVENTION

This invention relates generally as indicated to a cushioning conversion machine/method including a pad-transferring device/step.

BACKGROUND OF THE INVENTION

In the process of shipping an item from one location to another, a protective packaging material is typically placed in the shipping case, or box, to fill any voids and/or to cushion the item during the shipping process. Some conventional commonly used protective packaging materials are plastic foam peanuts and plastic bubble wrap. While these conventional plastic materials seem to adequately perform as cushioning products, they are not without disadvantages. Perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

These and other disadvantages of conventional plastic packaging materials has made paper protective packaging material a very popular alterative. Paper is biodegradable, recyclable and renewable; making it an environmentally responsible choice for conscientious industries. While paper in sheet form could possibly be used as a protective packaging material, it is usually preferable to convert the sheets of paper into a relatively low density pad-like cushioning dunnage product. This conversion may be accomplished by a cushioning conversion machine, such as those disclosed in U.S. Pat. Nos. 4,026,198; 4,085,622; 4,109,040; 4,237,776; 4,557,716; 4,650,456; 4,717,613; 4,750,896; 4,884,999; 4,968,291; 5,061,543; 5,188,581; and 5,322,477. These patents are assigned to the assignee of the present application and their entire disclosures are hereby incorporated herein by reference.

A cushioning conversion machine, such as those disclosed in the above-identified patents, usually includes a stock supply assembly, a forming assembly, a feeding assembly, and a severing assembly. During operation of the machine, the stock supply assembly supplies the stock material to the forming assembly and the feeding assembly. The forming assembly and the feeding assembly (which may be collectively referred to as the converting assembly) convert the sheet-like stock material into a strip having two pillow-like portions and a compressed connecting portion therebetween which maintains the geometry of the pillow-like portions. Specifically, the forming assembly causes inward rolling of the lateral edges of the stock material to form the pillow-like portions and the feeding assembly (which pulls the stock material through the forming assembly) coins the central band of the strip to form the compressed connecting portion. The severing assembly then cuts the strip of dunnage into sections or pads of a desired length.

Typically, the cut cushioning pad is transferred downstream to a transitional zone (e.g., a table, a conveyor belt, a bin etc.) and is thereafter removed from the transitional zone and inserted within a container for cushioning purposes. To aid in this transfer, the transitional zone may be positioned beneath the severing assembly whereby gravity will cause the cushioning pad to fall towards the transitional zone, or, in other words, away from the severing assembly. Additionally or alternatively, the approaching coined strip would urge the cut cushioning pad in the downstream direction.

The practice of depending upon the force of gravity and/or the urging of the approaching strip for pad-transferring purposes has, for the most part, been very successful. Nevertheless, in certain circumstances (such as high/constant volume cushioning situations), pad-transfer problems sometimes, albeit very rarely, occur. For example, because of the lightweight nature of the pad, one would occasionally fail to travel downstream to the transitional zone. While, in most instances, the approaching pads would eradicate this failure by pushing the "stalled" pad downstream, periodically the approaching pads would instead "shingle" (i.e., the pads would stack one on top of the other in a shingle-like arrangement). Such shingling (although itself uncommon) would usually result in the "jamming" the cushioning conversion machine and this jamming would almost always translate into machine downtime.

In the past, pad-transferring devices have been used in conjunction with cushioning conversion machines. For example, U.S. patent application Ser. No. 08/154,911 to Simmons (filed Nov. 19, 1993 and entitled "CUSHIONING CONVERSION MACHINE INCLUDING A PAD-TRANSFERRING ASSEMBLY") discloses a pad-transferring assembly or device including a conveyor which frictionally engages the strip prior to it being cut and frictionally transfers the cut pad away from the severing assembly. The conveyor belt spans the width of the cushioning product and thus frictionally engages the pillow-like portions of the cushioning pad during the transfer procedure. Also, U.S. patent application Ser. No. 08/942,569 to Ratzel et al. (filed Oct. 1, 1997 and entitled "CUSHIONING CONVERSION MACHINE") discloses an output chute including a number of vanes radially extending from a shaft which may be rotatably driven by the motor of the feeding assembly. The vanes span the width of the cushioning product and thus engage the pillow-like portions of the cushioning pad The inventors appreciated that when transferring force is imparted upon the pillow-like portions of the cushioning product, a balance was necessary between providing a sufficient transferring force which, at the same time, would not unduly deform the pillow-like portions of the cushioning product. Accordingly, the inventors appreciated that a pad-transferring device which did not deform the pillow-like portions of the cushioning product would be desirable and advantageous.

SUMMARY OF THE INVENTION

The present invention provides a pad-transferring device which concentrates its transferring force on a certain portion of a cushioning product, such as a portion of the pad compressed during the conversion process and which does not form part of the pillow-like portions of the cushioning product. In this manner, there is no need to worry about the device deforming the pillow-like portions of the cushioning product.

More particularly, the present invention provides a cushioning conversion machine comprising a converting assembly, a severing assembly, and a pad-transferring device. The converting assembly converts a sheet-like stock material into a strip of dunnage having at least one pillow-like portion and another portion and the severing assembly severs the strip to form a cushioning pad having at least one pillow-like portion and another portion. The other portion of the cushioning product (or strip of dunnage) is preferably compressed, centrally located, and/or performs a connecting function to maintain the geometry of the pillow-like portion. More preferably, the converting assembly converts the sheet-like stock material in such a manner that the strip of dunnage has two pillow-like portions and the compressed, central, and/or connecting portion therebetween.

The pad-transferring device transfers the cushioning pad away from the severing assembly by applying a transferring force which is concentrated at the other portion of the cushioning pad. Also preferably, the transferring force is at least great enough to move the cushioning pad at the same speed as the converting assembly is moving the strip of dunnage and, more preferably, the transferring force is greater than the force necessary to move the cushioning pad at the same speed as the converting assembly is moving the strip of dunnage whereby the cushioning pad will be transferred at a faster feed than it is converted.

In a first preferred embodiment of the cushioning conversion machine, the pad-transferring assembly includes a pair of rotating members which engage the other portion of the cushioning pad therebetween to apply the transferring force. The rotating transfer members preferably have a smooth outer surface which contacts the other portion of the cushioning pad.

In a second preferred embodiment of the cushioning conversion machine, the pad-transferring assembly includes a pair of rotating members which meshingly engage the other portion of the cushioning pad therebetween to apply the transferring force. The rotating transfer members are preferably of substantially the same size and shape as the gear members of the converting assembly which form the compressed central connecting portion of the cushioning pad.

In a third preferred embodiment of the cushioning conversion machine, the pad-transferring assembly includes a shelf on which the bottom of the cushioning pad rests and a rotating member which engages the top of the other portion of the cushioning pad to apply the transferring force. This rotating transfer member is also preferably of substantially the same size and shape as the gear members of the converting assembly which form the central compressed connecting portion of the cushioning product.

In a fourth preferred embodiment of the cushioning conversion machine, the pad-transferring assembly includes a pair of rotating members which engage the other portion of the cushioning pad therebetween to apply the transferring force. The rotating members each preferably include a plurality of radially extending flexible filaments which are positioned to engage only this portion of the cushioning product.

In a fifth preferred embodiment of the cushioning conversion machine, the pad-transferring assembly includes at least one fluid jet (preferably an air jet) which is positioned to direct fluid onto the other portion of the cushioning product to apply the transferring force. More preferably, two fluid jets are arranged to shoot fluid onto the top and bottom surfaces, respectively, of this portion of the cushioning product to apply the transferring force.

A preferred method according to the present invention includes the steps of converting a sheet-like stock material into a strip of dunnage having at least one pillow-like portion and another portion; severing the leading end of the strip of dunnage to form a cushioning pad having at least one pillow-like portion and another portion; applying a transferring force to the cushioning pad which is concentrated at the other portion of the cushioning pad. Preferably, the applying step comprises applying the transferring force to only the compressed connecting portion and/or the central portion of the cushioning pad. The transferring step may be performed at the same time as the converting and severing steps; only when the severing step is not being performed; only when the converting step is being performed; or only for a predetermined period of time after the severing step.

These and other features of the invention are fully described and particularly pointed out in the claims. The following descriptive annexed drawings set forth in detail one illustrative embodiment, this embodiment being indicative of but one of the various way in which the principles of the invention may be employed.

DRAWINGS

DETAILED DESCRIPTION

Figure 1A:
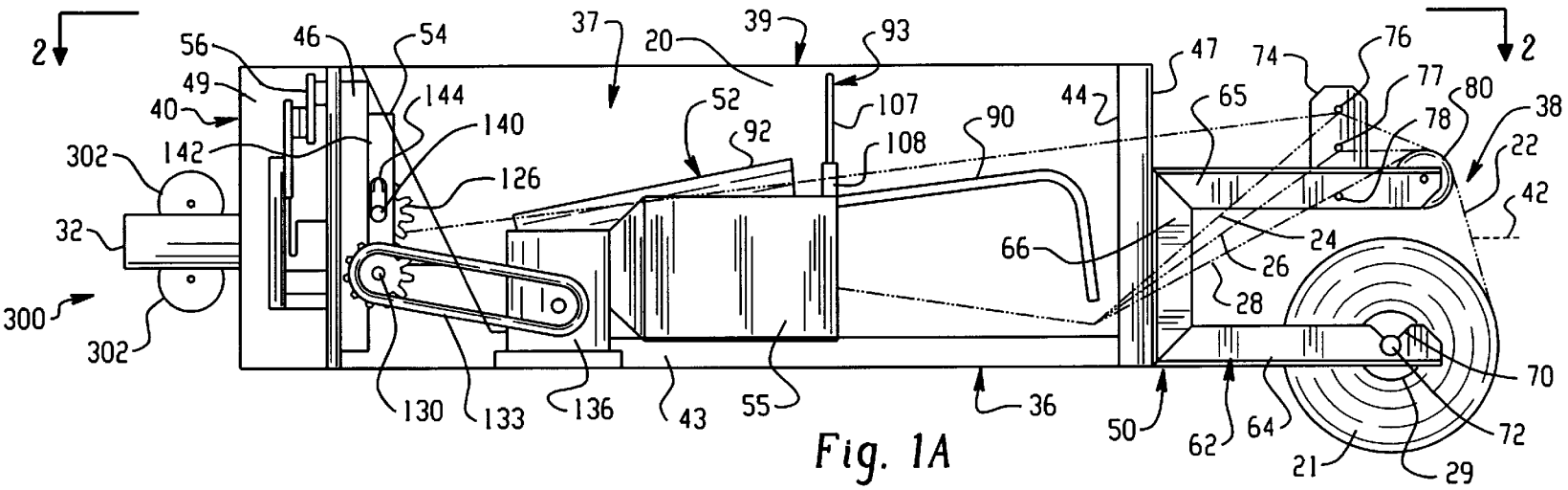
FIGS. 1A and 1B are opposite side views of a cushioning conversion machine including a first embodiment of a pad-transferring device according to the present invention, the machine being shown positioned in a horizontal manner, loaded with stock material, and with an outer housing side wall removed for clarity of illustration, the pad-transferring device being shown schematically.
Figure 1B:
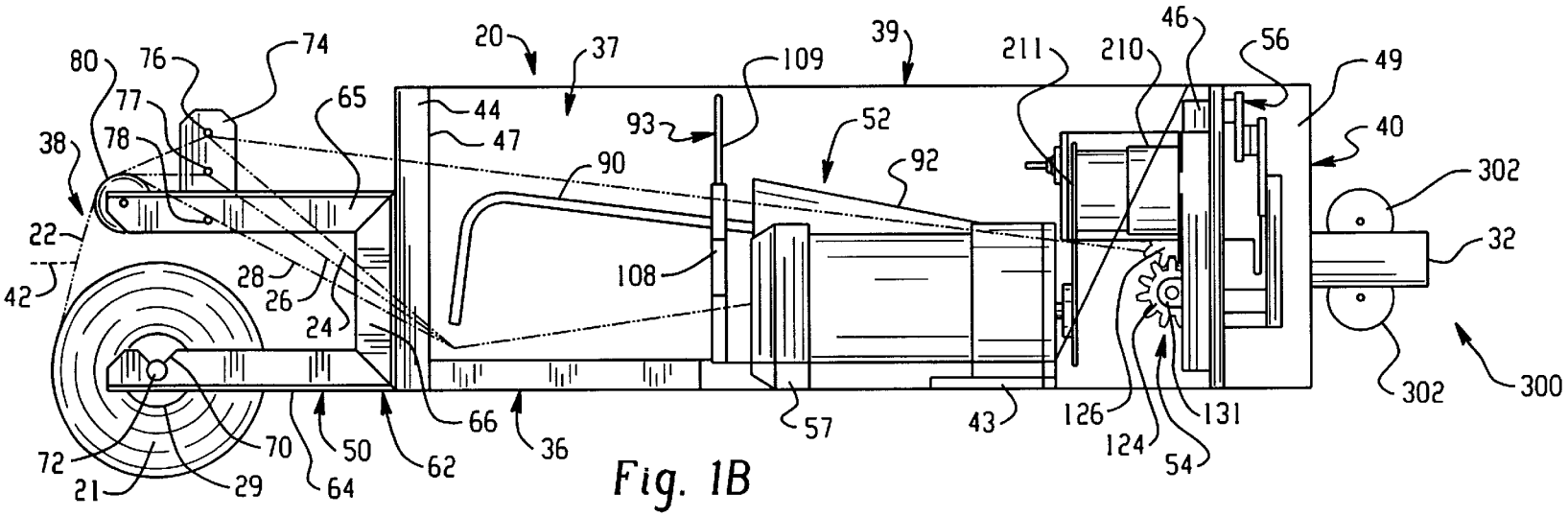
Figure 2:
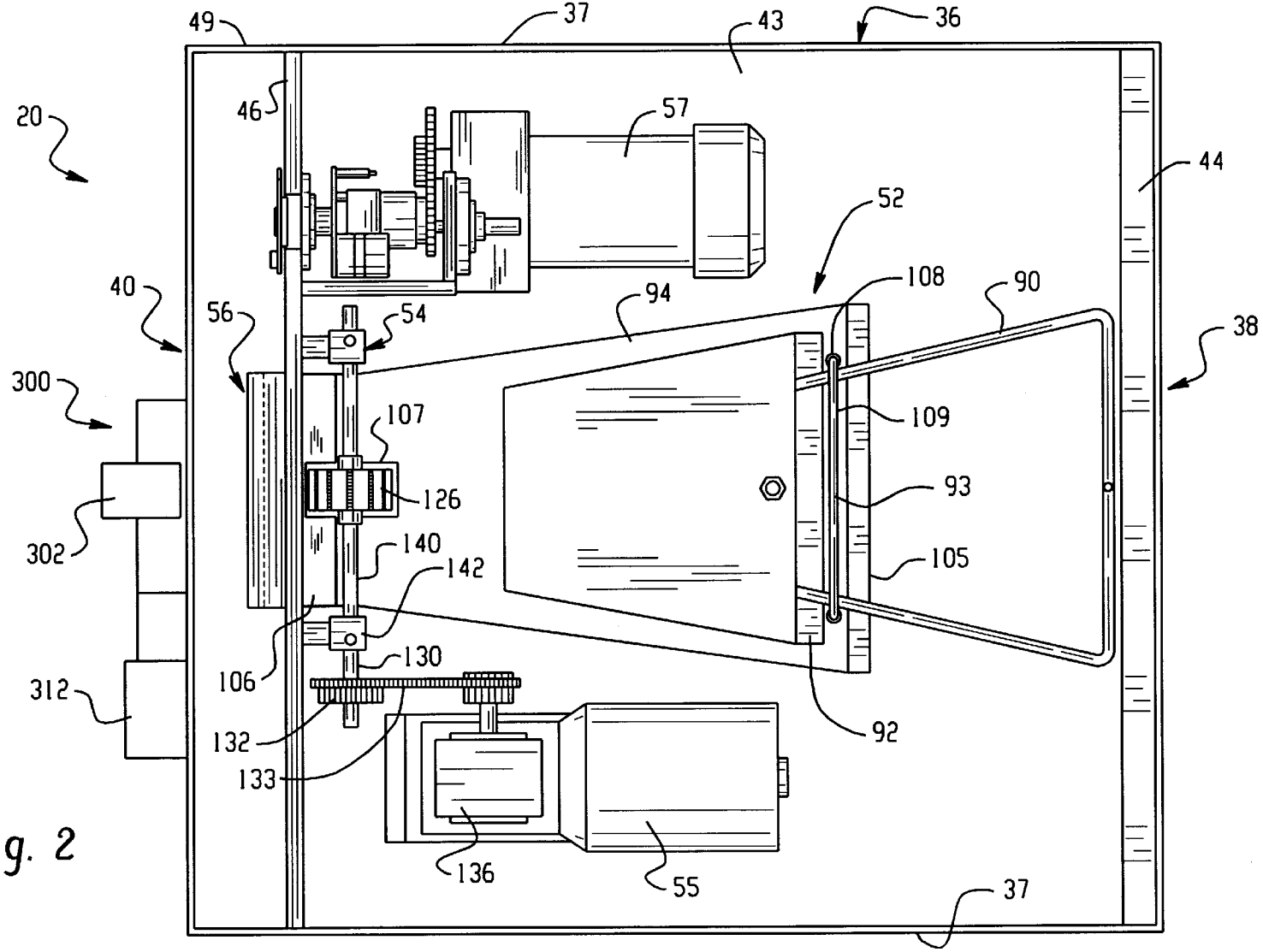
FIG. 2 is a top plan view of the cushioning conversion machine, without stock material being loaded and as seen along line 2—2 in FIG. 1A.

A cushioning conversion machine 20 according to the present invention is shown in FIGS. 1 and 2. In FIGS. 1A and 1B, the machine 20 is shown positioned in a horizontal manner and loaded with a roll 21 of sheet-like stock material 22. The stock material 22 may consist of three superimposed webs or layers 24, 26, and 28 of biodegradable, recyclable and reusable thirty-pound Kraft paper rolled onto a hollow cylindrical tube 29. A thirty-inch roll of this paper, which is approximately 450 feet long, will weigh about 35 pounds and will provide cushioning equal to approximately four 15 $ft^3$ bags of plastic foam peanuts while at the same time requiring less than one-thirtieth the storage space.

Figure 3:
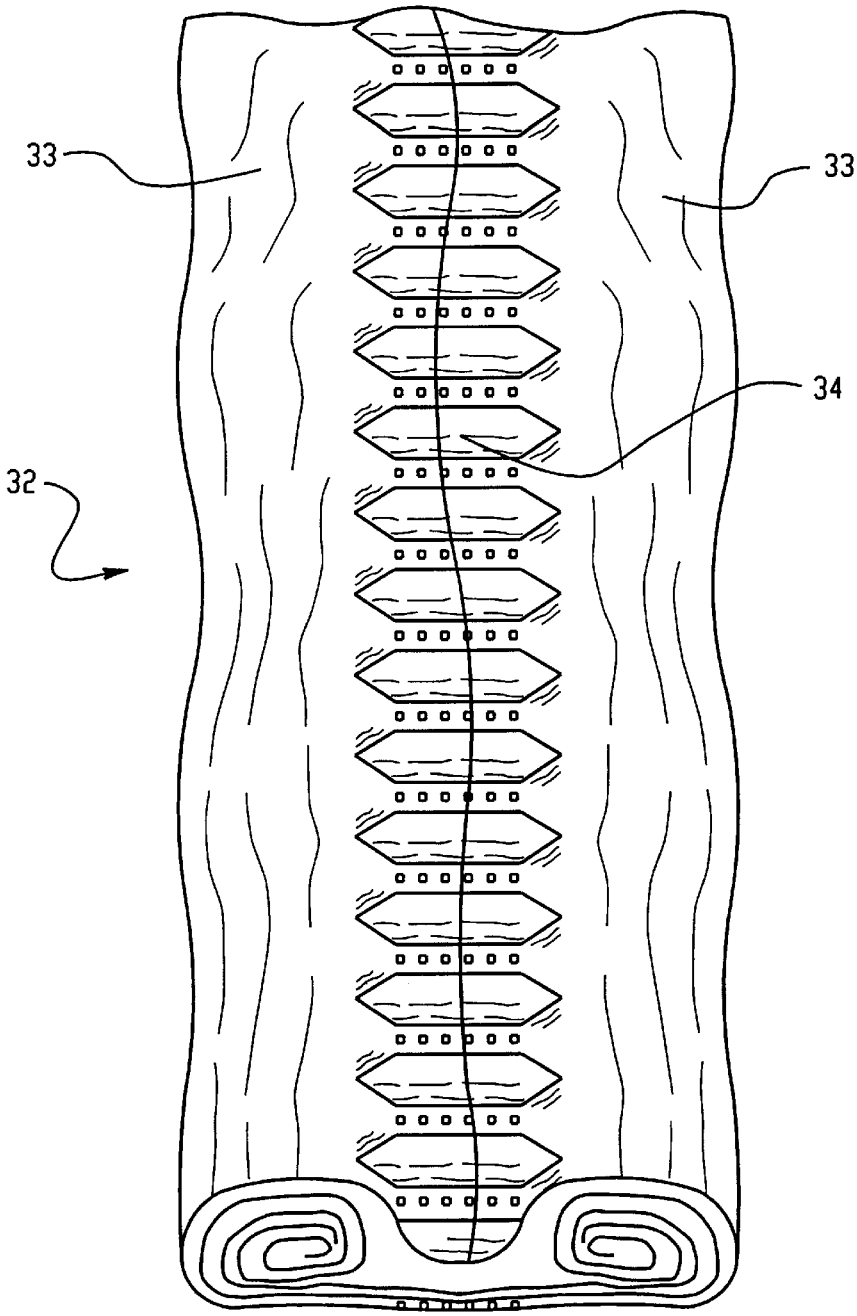
FIG. 3 is a perspective view of a cushioning product produced by the cushioning conversion machine.
Figure 4:
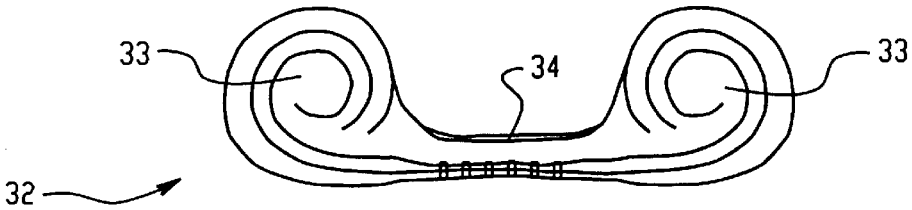
FIG. 4 is an end view of the cushioning product produced by the cushioning conversion machine.

The machine 20 converts this stock material 22 into a continuous unconnected strip having lateral pillow-like portions separated by a thin central band. This strip is connected along the central band to form a connected strip 31 which is cut into sections or pads 32 of a desired length. As can been seen by referring briefly to FIGS. 3 and 4, the cut cushioning pads 32 each include two lateral pillow-like portions 33 separated by a central coined band or compressed connecting portion 34 which maintains the geometry of the pillow-like portions 33. Thus, the cushioning product 32 includes at least one, and preferably two pillow-like portions 31, and another portion 34. The portion 34 is compressed, coined, centrally located, and connects the stock material to maintain the geometry of the pillow-like portions(s) 33.

The machine 20 includes a housing having an upstream or "feed" end 38 and a downstream or "discharge" end 40. The terms "upstream" and "downstream" in this context are characteristic of the direction of flow of the stock material 22 through the machine 20. The housing 36 is positioned in a substantially horizontal manner whereby an imaginary longitudinal line or axis 42 from the upstream end 38 to the downstream end 40 would be substantially horizontal.

The housing 36 includes side walls 37, a top or cover wall 39, a base plate or wall 43 and two end walls 44 and 46. The frame base wall 43 is generally rectangular and extends from the upstream end 38 to the downstream end 40 of the frame 36 in a generally horizontal plane. Although not perfectly apparent from the illustrations, the first or upstream wall 44 may be more specifically described as a thin rectangular wall having a rectangular stock inlet opening 47 passing therethrough. Alternatively, instead of the end wall 44, the side and base walls 37 and 43 may have upstream inwardly turned end sections that form a rectangular border around the stock inlet opening 47. The second or downstream end wall 46 is generally rectangular and planar and includes a relatively small rectangular outlet opening.

The first frame end wall 44 extends generally perpendicular in one direction from the upstream end of the frame base wall 43. (In FIGS. 1A and 1B. this direction is upward.) The second end wall 46 is preferably aluminum and extends in generally the same perpendicular direction from the downstream end of the frame base wall 43. In this manner, the frame 36 is basically "C" shape and one side of the frame base wall 43, which in this embodiment is the lower side, is a flat uninterrupted surface. The frame 36 also includes a box-like extension 49 removably attached to a downstream portion of the base wall 43. Although not shown in all of the drawings, the frame may be enclosed by a sheet metal housing, including side walls 37 and a top wall or cover 39.

The machine 20 further includes a stock supply assembly 50, a forming assembly 52, a feeding assembly 54 powered by a feed motor 55, and a severing assembly 56 powered by a cutter motor 57. In operation of the machine 20, the stock supply assembly 50 supplies the stock material 22 to the forming assembly 52. The forming assembly 52 causes inward rolling of the lateral edges of the sheet-like stock material 22 to form the lateral pillow-like portions 33 of the continuous strip. The feeding assembly 54 pulls the stock material 22 from the stock roll 21, through the stock supply assembly 50, and through the forming assembly and also connects or stitches the central band of the strip to form the connected strip. As the connected strip travels downstream from the feeding assembly 54, the severing assembly 56 cuts the strip into sections 32 of a desired length.

Turning now to the details of the various assemblies, the stock supply assembly 50 includes two laterally spaced brackets 62. The brackets 62 are each generally shaped like a sideways "U" and have two legs 64 and 65 extending perpendicularly outward from a flat connecting base wall 66. (See FIGS. 1A and 1B.) For each bracket 62, the base wall 66 is suitably secured to the downstream side of the frame end wall 44, such that the leg 64 is generally aligned with the frame base wall 43. Both of the legs 64 have open slots 70 in their distal end to cradle a supply rod 72. The supply rod 72 is designed to extend relatively loosely through the hollow tube 29 of the stock roll 21. As the stock material 22 is pulled through the machine 20 by feeding assembly 54, the tube 29 will freely rotate thereby dispensing the stock material 22. A pin (not shown) may be provided through one or both ends of the supply rod 72 to limit or prevent rotation of the supply rod 72 itself.

The other legs 65 of the U-brackets 62 extend from an intermediate portion of the frame end wall 44 and cooperate to mount a sheet separator, indicated generally at 74. The sheet separator 74 includes three horizontally spaced relatively thin cylindrical separating bars 76, 77 and 78. The number of separating bars, namely three, corresponds to the number of paper layers or webs of the stock material 22. The sheet separator 74 separates the layers 24, 26 and 28 of paper prior to their passing to the forming assembly 52. This "preseparation" is believed to improve the resiliency of the produced dunnage product. Details of a separating mechanism similar to the separator 74 are set forth in U.S. Pat. No. 4,750,896. (This patent is assigned to assignee of the present application and its entire disclosure is hereby incorporated by reference.)

The bracket legs 65 also cooperate to support a constant-entry bar 80 which is rotatably mounted on the distal ends of the legs. The bar 80 provides a non-varying point of entry for the stock material 22 into the separator 74 and forming assembly 52, regardless of the diameter of the stock roll 21. Thus, when a different diameter roll is used and/or as dispensation of the stock material 22 from roll 21 decreases its diameter, the point of entry of the stock material 22 into the separator 74 remains constant. This consistency facilitates the uniform production of cushioning dunnage. Details of a "roller member" or a "bar member" similar to the constant-entry bar 80 are set forth in U.S. Pat. No. 4,750, 896.

After the stock material 22 is pulled from the stock roll 21 over the constant-entry bar 80 and through the sheet separator 74, it passes through the forming assembly 52 and the feeding assembly 54 which may be collectively referred to as the converting assembly. Specifically, the stock material 22 is pulled through the stock inlet opening 47 to the forming assembly 52. The forming assembly 52 includes a three-dimensional bar-like shaping member 90 (or forming frame), a converging chute 92, a transverse guide structure 93 and a guide tray 94. The stock material 22 travels between the shaping member 90 and the frame base wall 43 until it reaches the guide tray 94. At this point, the transverse guide structure 93 and the guide tray 94 guide the stock material 22 longitudinally and transversely into the converging chute 92. During this downstream travel, the shaping member 90 rolls the edges of the stock material 22 to form the lateral pillow-like portions 33 and the converging chute 92 coacts with the shaping member 90 to form the continuous strip. As the strip emerges from the converging chute 92, the guide tray 94 guides the strip into the feeding assembly 54.

The shaping member 90 is a three-dimensional forming frame having a V-like, in plan body and generally U-shaped, in end elevation, ribs extending downwardly from and generally transverse to the body portion. Further structural details of the shaping member 90 or "forming frame' are set forth in U.S. Pat. No. 4,750,896.

The guide tray 94 is directly mounted on the frame base wall 43; while the transverse guide structure 93 and the converging chute 92 are mounted on the guide tray 94. The guide tray 94 is trapezoidal in shape, as viewed in plan, having a broad upstream side 105 and a parallel narrow downstream side 106. The broad side 105 is positioned downstream of at least a portion of the shaping member 90. The narrow side 106 is positioned adjacent the outlet opening in the frame end wall 46 and includes a rectangular slot 107 to accommodate the feeding assembly 54. The guide tray 94 is not positioned parallel with the frame base wall 43, but rather slopes away (upwardly in FIGS. 1A and 1B) from the frame base wall 43 to the feeding assembly 54.

The converging chute 92 is mounted on the guide tray 94 upstream of at least a portion of the shaping member 90 and downstream slightly from the broad side 105 of the guide tray 94. The transverse guide structure 93 is mounted on the guide tray 94 just upstream of the entrance mouth of the converging chute 92. The transverse guide structure 93 includes rollers 108 rotatably mounted on a thin U-bracket 109. The distal ends of the U-bracket 109 are secured to the guide tray 94. Except for this mounting arrangement, the transverse guide structure 93 is similar to the "rollers and wire frame" disclosed in U.S. Pat. No. 4,750,896.

With the guide tray 94 and the transverse guide structure 93 mounted in this manner, the stock material 22 travels over the guide tray 94, under the upstream end of the shaping member 90, between the rollers 108 of the transverse guide structure 93, and into the converging chute 92. The basic cross-sectional geometry and functioning of the converging chute 92 is similar to that of the converging member described in U.S. Pat. No. 4,750,896.

Alternatively, the forming assembly 52 may include the chute and/or the shaping member disclosed in U.S. patent application Ser. No. 08/487,179. (This application is assigned to the assignee of the present application and its entire disclosure is hereby incorporated by reference.) Such a chute has an inlet end which is outwardly flared in a trumpeted fashion to facilitate passage of the stock material into the shaping chute. (The trumpet-like inlet may eliminate the need for the transverse guide structure 93.) Such a shaping member is longitudinally formed into a U-shape comprised of a first leg attached to a top wall of the chute and a second leg extending into the chute generally parallel with the bottom wall of the chute.

The stock material 22 will emerge from the chute 92 as the continuous unconnected strip. The emerging strip is guided to the feeding assembly 54 by the narrow downstream end 106 of the guide tray 94, which extends from the outlet opening of the chute to the outlet opening in the frame end wall 46. The feeding assembly 54 includes rotating feed members between which the stock material 22 travels, specifically loosely meshed horizontally arranged drive gear 124 and idler gear 126. When the gears 124 and 126 are turned the appropriate direction, which in FIG. 1A would be counterclockwise for gear 124 and clockwise for gear 126, the central band of the strip is grabbed by the gear teeth and pulled downstream through the nip of gears 124 and 126. This same "grabbing" motion caused by the meshing teeth on the opposed gears 124 and 126 simultaneously compresses or "coins" the layers of the central band together thereby connecting the same and forming the connected strip.

The drive gear 124 is positioned between the frame base wall 43 and the guide tray 94 and projects through the rectangular slot 107 in the guide tray 94. The gear 124 is fixedly mounted to a shaft 130 which is rotatably mounted to the upstream side of the frame end wall 46 by bearing structures 131. A sprocket 132 at one end of the shaft accommodates a chain 133 which connects the shaft 130 to a speed reducer 136. The speed reducer 136 acts as an interface between the feeding assembly 54 and the feed motor 55 for controlling the rate of "pulling" of the stock material 22 through the machine 20. As is best seen in FIG. 1A, the feed motor 55 and the speed reducer 136 are mounted on the frame base wall 43 at approximately the same level as the forming assembly 52.

The idler gear 126 is positioned on the opposite side of the guide tray 94 and is rotatably mounted on a shaft 140. Shaft brackets 142 attached to an upstream side of the frame end wall 46 non-rotatably support the ends of the shaft 140 in spring-loaded slots 144. The slots 144 allow the shaft 140, and therefore the idler gear 126, to "float" relative to the drive gear 124 thereby creating an automatic adjustment system for the feeding assembly 54.

Alternatively, the automatic adjustment system for feeding assembly 54 could be of the type disclosed in U.S. patent application Ser. No. 08/487,179. In such an adjustment system, first and second tie members would be movably connected to the shaft 140 and would extend transversely with respect to the shaft 140. Each of the tie members would have one end in fixed transverse position relative to the machine's frame 36 and an adjustable stop which is selectively adjustable towards and away from the shaft 140. A spring member would be interposed between the shaft 140 and the adjustable stop to resiliently bias the shaft 140 towards the shaft 130. In this manner, the pinch force applied by the rotating feed members 124 and 126 could be adjusted without changing a minimum set distance between the shafts 130 and 140.

The rotating feed members 124 and 126 may include projections which perforate the stock material to further stitch or connect the cushioning product, such as the rotating feed members disclosed in U.S. Pat. No. 4,968,291. (This patent is assigned to the assignee of the present application and its entire disclosure is hereby incorporated by reference.) Additionally or alternatively, the rotating feed members 124 and 126 may be of the type contained in the stitching assembly disclosed in U.S. patent application Ser. No. 08/607,607. (This application is assigned to the assignee of the present application and its entire disclosure is hereby incorporated by reference.) In such a stitching assembly, the first rotating feed member would have a plurality of radially outwardly extending projections around its circumference and the projections would have at axially spaced apart segments defining a recess therebetween. The second rotating feed member would have axial punch segments which each include a peripheral edge portion for receipt into the first member's recesses. The peripheral edge portions would have opposite corners which are cooperative with the first member's projections to cut a row of slits in the overlapped portions of the stock material to interlock these overlapped portions.

In any event, the feeding assembly 54 transforms the unconnected strip into the connected strip 31 and this strip 31 travels through the outlet opening 48 in the frame end wall 46. The connected strip is then cut by the severing assembly 56 into cut sections 32 of the desired length. The severing assembly 56 may be of any suitable type, such as the types disclosed in U.S. Pat. No. 5,123,899, the type disclosed in U.S. patent application Ser. No. 08/110,349, and/or the type disclosed in U.S. patent application Ser. No. 08/188,305. (This patent and these applications are assigned to the assignee of the present invention and their entire disclosures are hereby incorporated by reference. ) However, whatever type of severing or cutting assembly is used, the connected strip 31 is divided into cut sections 32 of the desired length, the conversion of stock material 22 to cut sections or pads 32 of relatively low density cushioning dunnage product now being complete.

Figure 5:
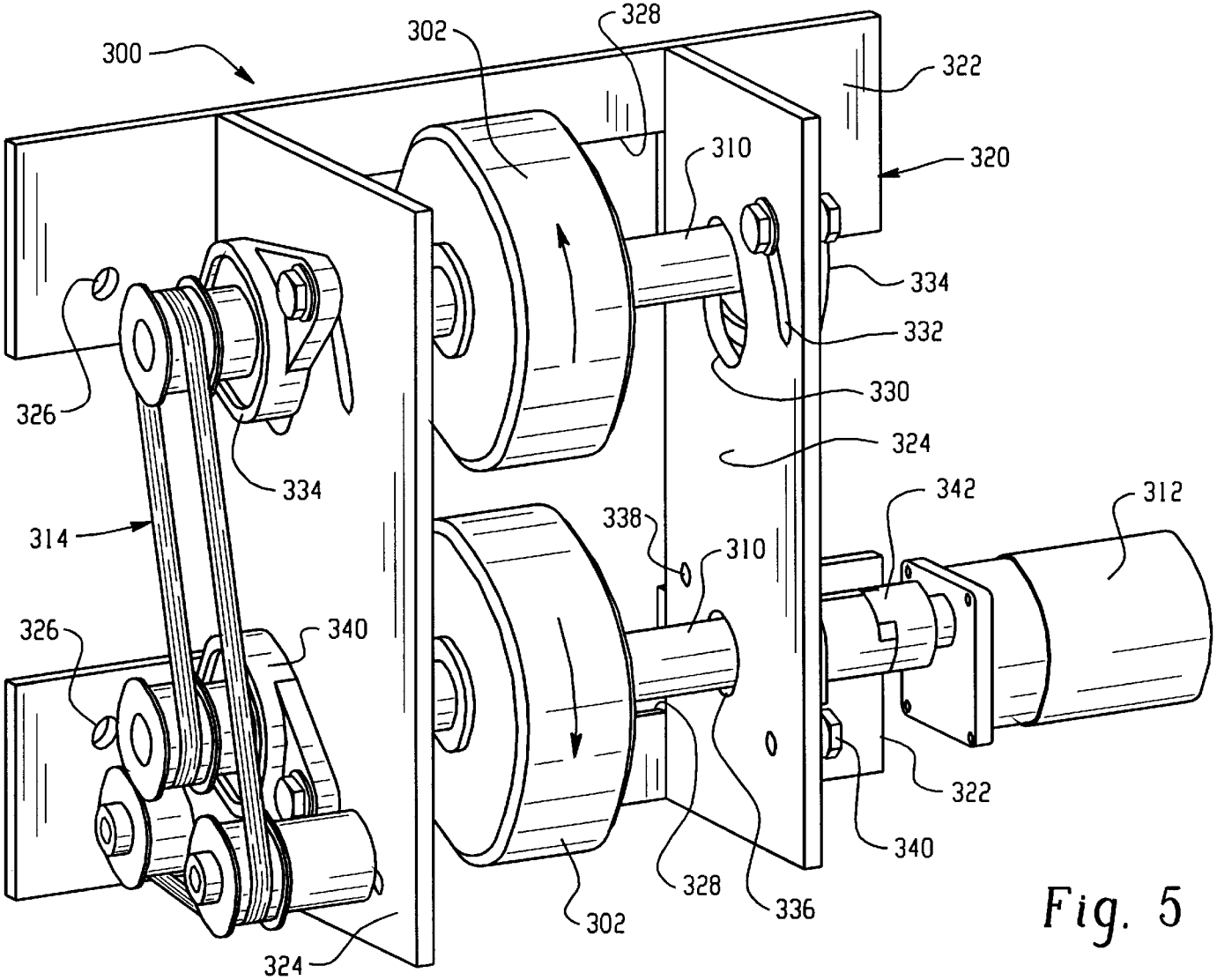
FIG. 5 is a downstream perspective view of the first embodiment of the pad-transferring device.

The cushioning pads 32 are transferred away from the severing assembly 56 by a pad-transferring device 300 according to the present invention which is shown in more detail in FIG. 5. The pad-transferring device 300 includes a pair of counter rotating transferring members 302 mounted on respective shafts 310 which rotate via rotational movement from a motor 312 being transferred thereto by a belt drive system 314. The shafts 310 and motor 312 are suitably mounted to the downstream wall of the frame extension 49 whereby the pad-transferring device 300, and more specifically the rotating transfer members 302, are positioned downstream of the severing assembly 56. When the transfer members 302 are rotated in a downstream direction, the pad-transferring device 300 transfers the cushioning pad away from the severing assembly 56 by applying a transferring force to the cushioning pad 32.

The rotating members 302 each have a smooth outer surface which is positioned to contact therebetween only the top and bottom surfaces of the other portion 34 of the cushioning product 32. Thus, the rotating members 302 have an axial dimension approximately equal to the width of the central compressed portion 34 of the cushioning pad 32 and are positioned to contact only the central compressed portion 34 of the cushioning pad. In this manner, the transferring force is concentrated at the central compressed portion 34 of the cushioning pad 32. Also, because the rotating members 302 apply the transfer force at the center region of the cushioning product 32, the pad-transferring device may also serve as a guiding device which guides the cushioning product 32 in a straight line.

While the rotating members 302 preferably have a smooth outer surface, this surface should be of a sufficiently frictional character to interact with the portion 34 of the cushioning pad 32. For example, if additional frictional forces would be required, one or both rotating members 302 could be equipped with at least one peripheral elastomeric O-ring.

As was indicated above, the rotating members 302 and their shafts 310 are suitably mounted to the downstream wall of the frame extension 49. In the illustrated embodiment, this mounting is accomplished by a brace 320 comprising two spaced plate members 322 and two spaced plate members 324. The plate members 322 are oriented in a vertical plane (in the illustrated machine orientation) perpendicular to the machine's upstream-downstream direction. In the cushioning conversion machine 20, the plate members 322 are positioned flush against the back wall of the frame extension 49 adjacent the top and bottom sides, respectively, of the outlet opening on the frame extension 49, and are attached thereto by suitable fasteners members, such as bolts extending through appropriate openings 326. Each of the plate members 322 include a rectangular cut-out or slot 328 along its inner edge (or the edge closest to the outlet). The cut-outs 328 accommodate an upstream portion of the rotating members 302 as they rotate during the pad-transferring process.

The plate members 324 are also oriented in a vertical plane, but they are position parallel to the machine's upstream-downstream direction and thus perpendicular to the plate members 322. The top upstream edge of each of the plate members 324 is attached (such as by welding) to upper plate member 322, adjacent the respective side edges of the cut-out 328 in the upper plate member. The lower upstream edge of each of the plate members 324 is similarly attached to the lower plate member 322, adjacent the respective side edges of the cut-out 328 in the lower plate member. Thus, the plate members 324 extend perpendicularly downstream from the plate members 322.

The plate members 324 each include an opening 330 to accommodate the upper shaft 310 and another opening 332 to accommodate the shaft's bearing member 334. Preferably, the openings 330 and 332 are in the form of elongated slots whereby their relative position may be adjusted during assembly or repairs. The plate members 324 also each include an opening 336 to accommodate the lower shaft 310 and openings 338 to accommodate the shaft's bearing 340.

In the pad-transferring assembly 300, both of the shafts 310, and thus both of the rotating members 302, are rotatably driven by the motor 312. The motor 312 is coupled in line to the lower shaft 310 via a flexible connector 342, outside one of the plate members 324 (the right hand plate member 324 in FIG. 5.) The opposite end of the lower shaft 310 transfers rotational motion to the belt drive system 314 which in turn transfers the motion to the upper shaft 310 in an opposite directional rotation. The motor 312 and/or clutch 342 may be mounted to the appropriate plate member 324 (the right hand one in FIG. 5), or may be mounted to the machine's extension 49. The components of the belt drive system 314 may be mounted to the other plate member 324. While the belt drive system 314 is used in the illustrated embodiment to transfer rotational motion, any other suitable transfer system is possible with, and contemplated by, the present invention.

Although not specifically shown in the drawings, the pad-transferring assembly 300 may also include a cover which shields the some or all of its moving components. Such a cover would include an outlet opening through which the cushioning pad 32 would be transferred by the pad-transferring assembly 300. Additionally or alternatively, the pad-transferring assembly 300 may include a tunnel which forms a passageway from the frame extension outlet. Such a tunnel would preferably include top and bottom slots so that only the transferring portions of the rotating members 302 would extend into the tunnel (i.e., the bottom portion of the top rotating member and the top position of the bottom rotating member).

Figure 6:
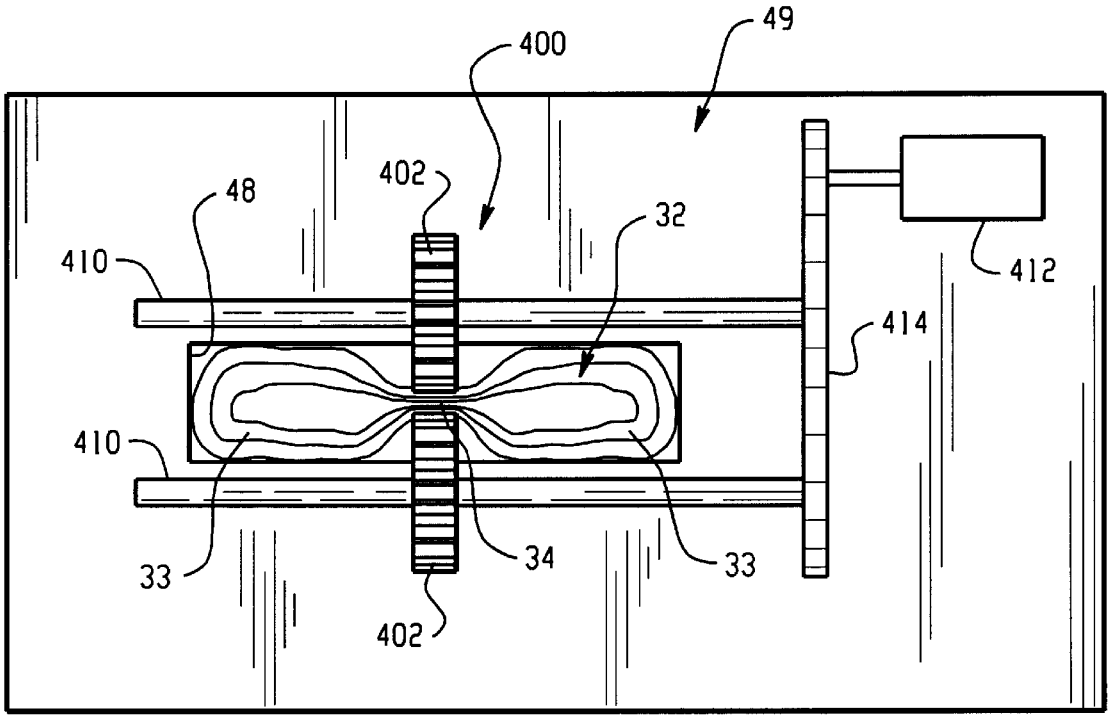
FIG. 6 is a downstream end view of the cushioning conversion machine.
Figure 7:
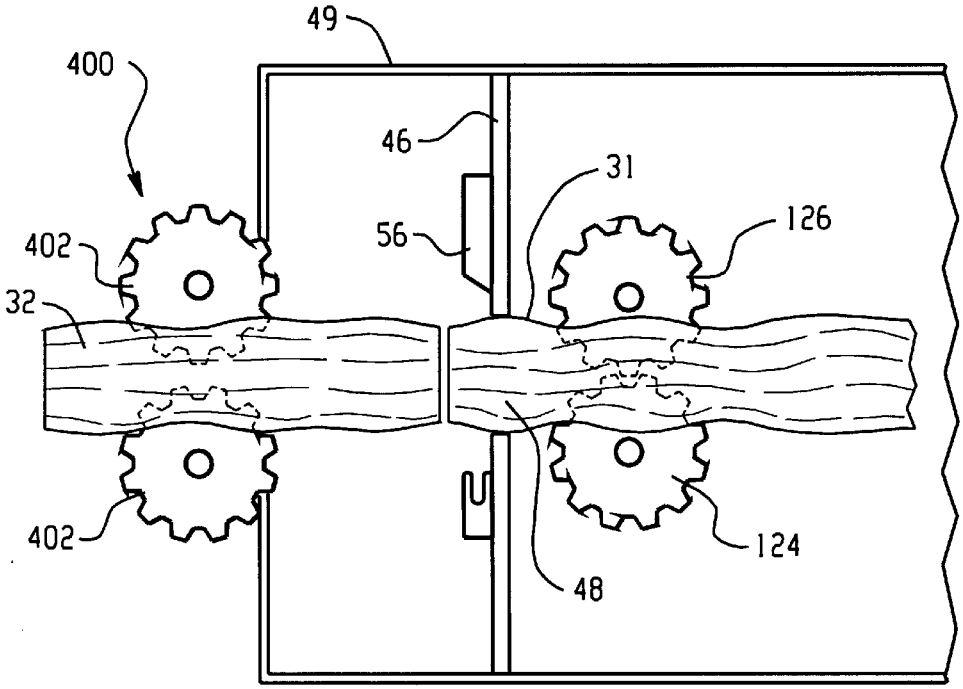
FIG. 7 is a partial side view of the cushioning conversion machine, the machine's feeding assembly and severing assembly being shown schematically and a side wall of the machine's housing being removed for better clarity.

A second embodiment 400 of a pad-transferring device according to the present invention is shown in FIGS. 6 and 7. The pad-transferring device 400 includes a pair of counter rotating transferring members 402 mounted on respective shafts 410 which rotate via rotational movement from a motor 412 and a belt drive system 414. (The motor 412 and belt drive system 414, which are shown schematically in the drawings, may be similar to the motor 312 and/or belt drive system 314, or may be of any other suitable design.) The shafts 410 and motor 412 are suitably mounted to the downstream wall of the frame extension 49 whereby the pad-transferring device 400, and more specifically the rotating transfer members 402, are positioned downstream of the severing assembly 56. When the transfer member 402 are rotated in the downstream direction, the pad-transferring device 400 transfers the cushioning pad away from the severing assembly 56 by applying a transferring force to the cushioning pad 32.

The rotating members 402 are of substantially the same size and shape as the coining gears 124 and 126 of the machine's feeding assembly 54 and are positioned to meshingly engage therebetween only the top and bottom surfaces of the portion 34 of the cushioning product 32. Thus, the rotating members 402 have an axial dimension approximately equal to the width of the compressed central portion 34 of the cushioning pad 32 and are positioned to contact only the compressed central portion 34 of the cushioning pad. In this manner, the transferring force is concentrated at the compressed central portion 34 of the cushioning pad 32. Also, because the rotating members 402 apply the transfer force at the center region of the cushioning product 32, the pad-transferring assembly 400 may also serve a guiding device which guides the cushioning product 32 in a straight line. Further, the rotating members 402 may include perforating or slitting elements, such as those on the rotating feed members disclosed in U.S. Pat. No. 4,968,291 or U.S. patent application Ser. No. 08/607,607 whereby the pad-transferring assembly 400 may further serve as a post-severing stitching or connecting device. Such a post-severing device may be desirable, for example, if for some reason the severing assembly 56 causes the cushioning pad 32 to separate during the severing process.

Figure 8:
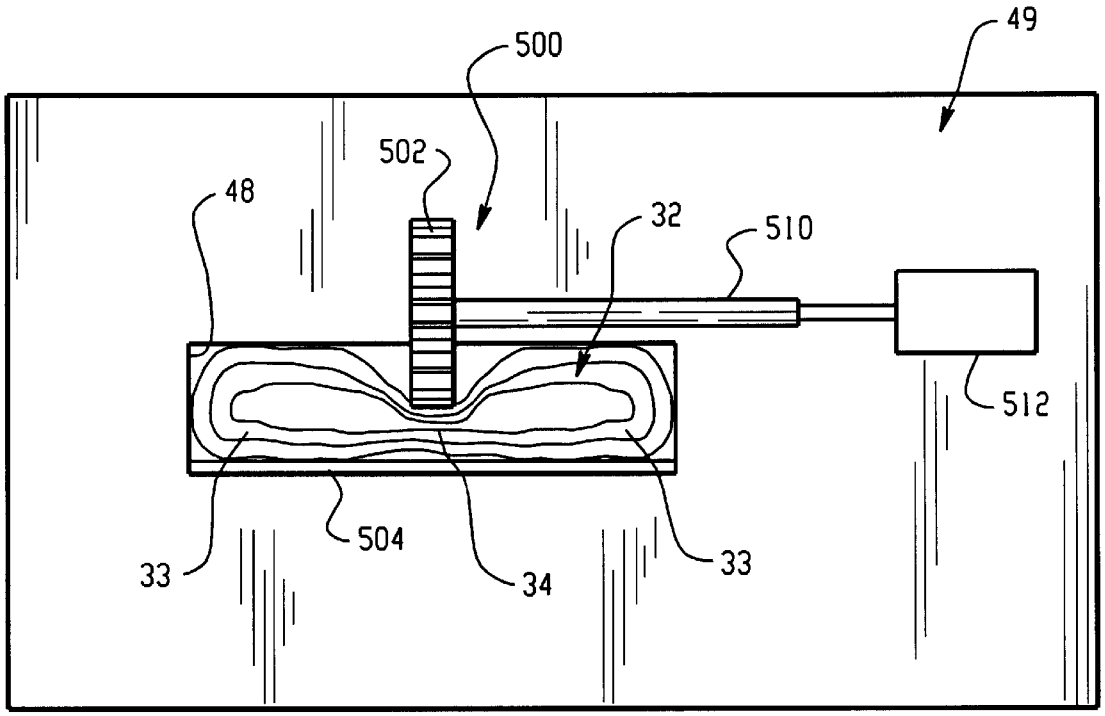
FIG. 8 is a downstream end view of the cushioning conversion machine incorporating a second embodiment of a pad-transferring device according to the present invention.
Figure 9:
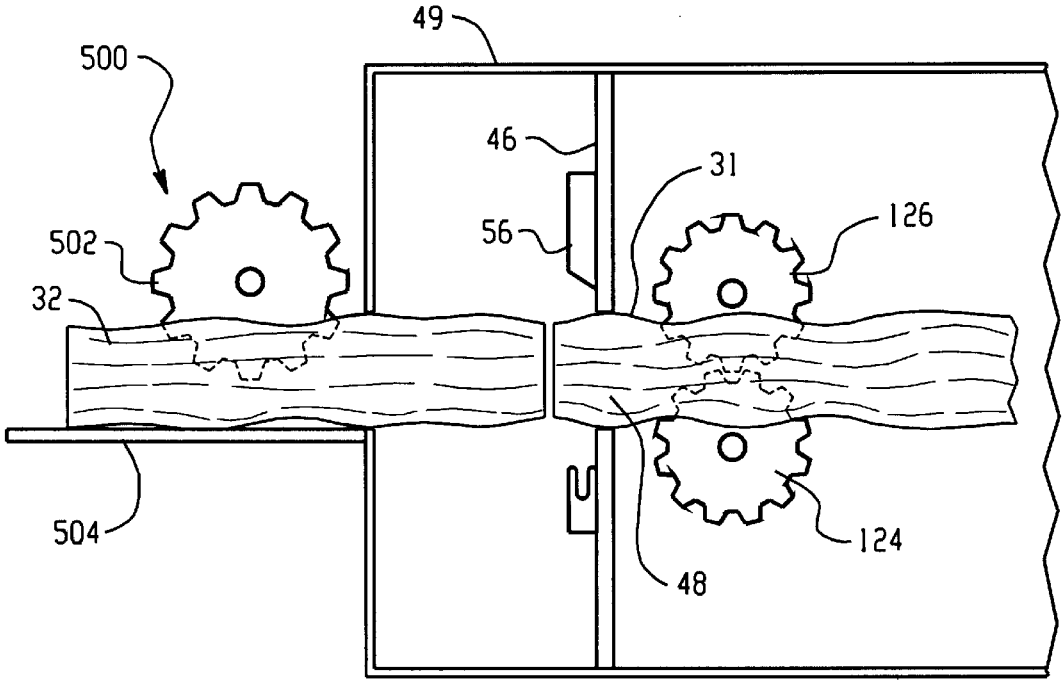
FIG. 9 is a side view of the cushioning conversion machine incorporating the second embodiment of the pad-transferring device, the machine's feeding assembly and severing assembly being shown schematically and a side wall of the machine's housing being removed for better clarity.

A third embodiment 500 of a pad-transferring device 500 according to the present invention is shown in FIGS. 8 and 9. The pad-transferring device 500 includes but one rotating transfer member 502 and a shelf 504. The rotating transfer member 502 is mounted on a shaft 510 which is rotated by a motor 512. The shaft 510 and the motor 512 are suitably mounted to the downstream wall of the frame extension 49 whereby the pad-transferring device 500, and more specifically the rotating transfer member 502 and the shelf 504, are positioned downstream of the severing assembly 56. When the transfer member 502 is rotated in the downstream direction, the pad-transferring device 500 transfers the cushioning pad away 32 from the severing assembly 56 by applying a transferring force to the cushioning pad 32.

The rotating member 502 is of substantially the same size and shape as the coining gears 124 and 126 of the machine's feeding assembly 54 and is positioned to engage only the top surface of the portion 34 of the cushioning product 32. (The shelf 504 may have appropriately positioned openings to coordinate with the geometry of the rotating member 502.) Thus, the rotating member 502 has an axial dimension approximately equal to the width of the compressed central portion 34 of the cushioning pad 32 and is positioned to contact only the top surface of the compressed central portion 34 of the cushioning pad. In this manner, the transferring force is concentrated at the compressed central portion 34 of the cushioning pad 32. Also, because the rotating member 502 applies the transfer force at the center region of the cushioning product 32, the pad-transferring device 500 may also serve as a guiding device which guides the cushioning product 32 in a straight line. Further, the rotating member 502 may include perforating or slitting elements, such as on the rotating feed members disclosed in U.S. Pat. No. 4,968,291 or U.S. patent application Ser. No. 08/607,607, whereby the pad-transferring device 500 may further serve as a post-severing stitching or connecting device.

Figure 10:
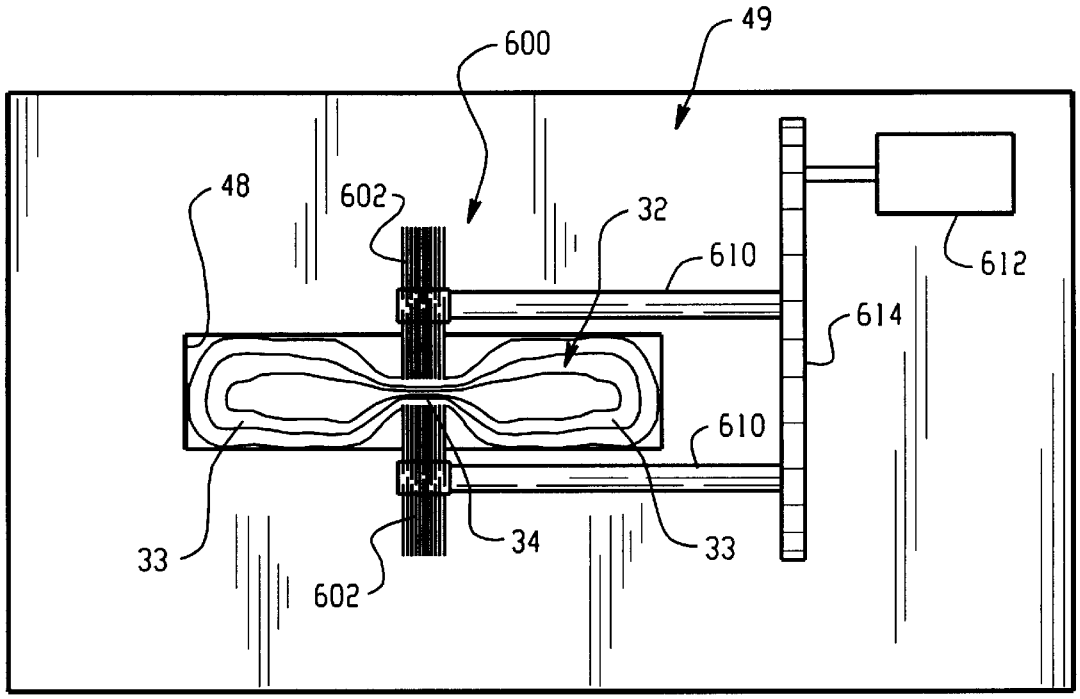
FIG. 10 is a downstream end view of the cushioning conversion machine incorporating a third embodiment of a pad-transferring device according to the present invention.
Figure 11:
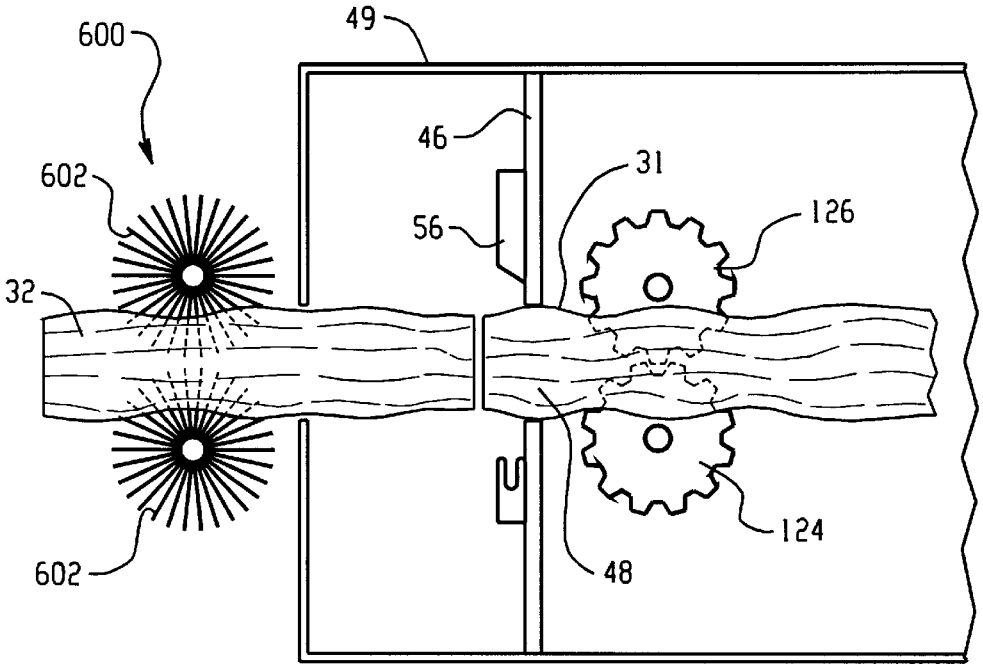
FIG. 11 is a side view of the cushioning conversion machine incorporating the third embodiment of the pad-transferring device, the machine's feeding assembly and severing assembly being shown schematically and a side wall of the machine's housing being removed for better clarity.

A fourth embodiment 600 of a pad-transferring device according to the present invention is shown in FIGS. 10 and 11. The pad-transferring device 600 includes a pair of rotating members 602 mounted on respective shafts 610 which counter rotated by a motor 612 and belt drive system 614. (The motor 612 and the drive belt system 614, which are shown schematically in the drawings, may be similar to the motor 312 and/or belt drive system 314, or may be of any other suitable design.) The shafts 610 and motor 612 are suitably mounted to the downstream wall of the frame extension 49 whereby the pad-transferring device 600, and more specifically the rotating transfer members 602, are positioned downstream of the severing assembly 56. When the transfer members 602 are rotated in the downstream direction, the pad-transferring device 600 transfers the cushioning pad away from the severing assembly 56 by applying a transferring force to the cushioning pad 32.

The rotating members 602 each include a plurality of flexible filaments radially extending from their core which are positioned to engage only the portion 34 of the cushioning product 32. The filaments axially extend for a distance approximately equal to the width of the compressed connecting portion 34 of the cushioning pad 32 and are positioned to contact only the compressed central portion 34 of the cushioning pad. In this manner, the transferring force is concentrated at the compressed central portion 34 of the cushioning pad 32. Also, because the rotating members 602 apply the transfer force at the center region of the cushioning product 32, the pad-transferring device 600 may also serve as a guiding device which guides the cushioning product 32 in a straight line.

Figure 12:
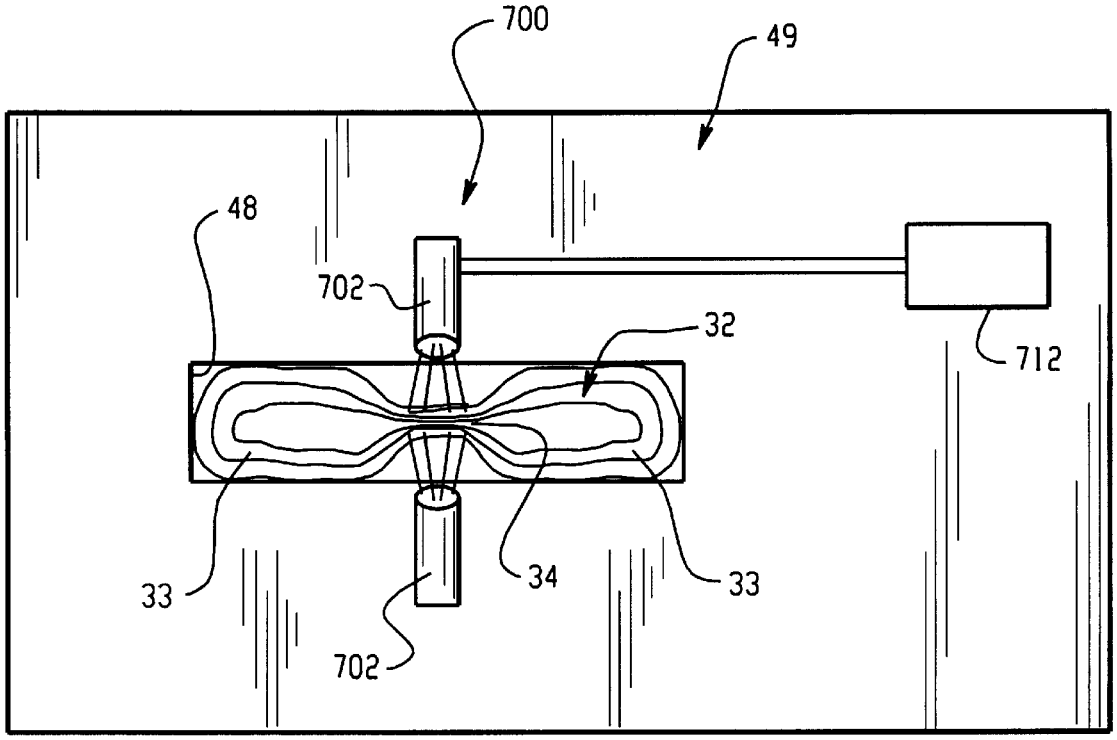
FIG. 12 is a downstream end view of the cushioning conversion machine incorporating a fourth embodiment of a pad-transferring device according to the present invention.
Figure 13:
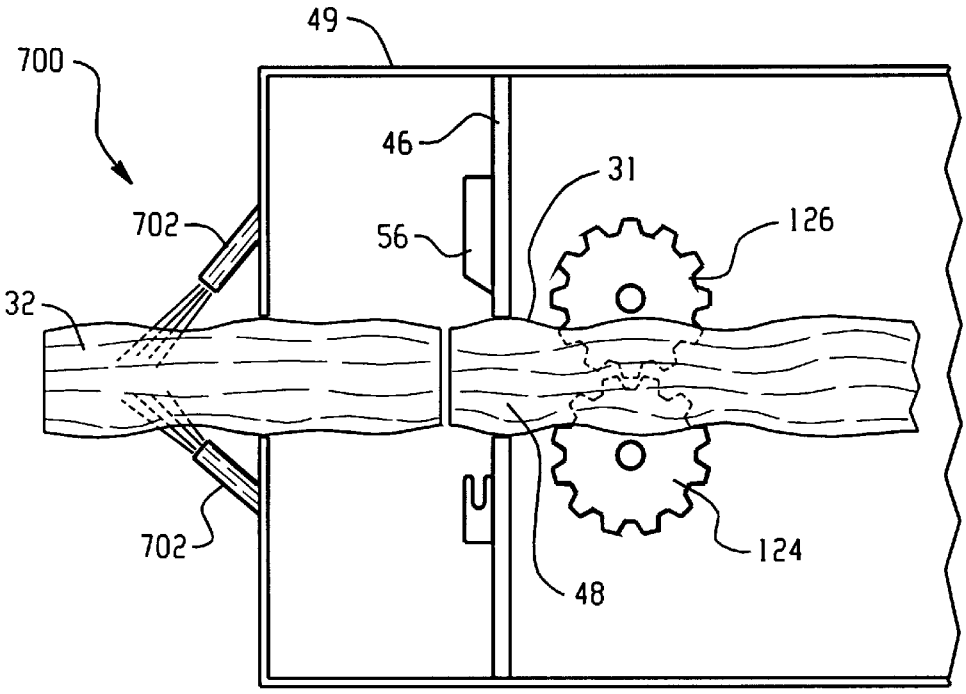
FIG. 13 is a side view of the cushioning conversion machine incorporating the fourth embodiment of the pad-transferring device, the machine's feeding assembly and severing assembly being shown schematically and a side wall of the machine's housing being removed for better clarity.

A fifth embodiment 700 of a pad-transferring device according to the present invention is shown in FIGS. 12 and 13. The pad-transferring device 700 includes a pair of angled transfer members, specifically jets 702, which receive a fluid (preferably air) from a fluid motor or source 712. The jets 702 are suitably mounted to the downstream wall of the frame extension 49 so that when jets 702 shoot fluid in the appropriate direction (to the left in FIG. 13), the pad-transferring device 700 transfers the cushioning pad away from the severing assembly 56 by applying a transferring force to the cushioning pad 32.

The jets 702 are designed to direct the fluid stream towards only the portion 34 of the cushioning product 32. In this manner, the transferring force is concentrated at the central compressed portion 34 of the cushioning pad 32. The jets 702 are positioned to direct the fluid stream towards the top and bottom of the cushioning pad 32. However, one fluid jet 702 may be used instead with, for instance, a shelf supporting the cushioning product 32, such as the shelf 504 used with the pad-transferring device 500. In any event, because the jets 702 apply the transfer force at the center region of the cushioning product 32, the pad-transferring device 700 may also serve as a guiding device which guides the cushioning product 32 in a straight line.

In the pad-transferring assemblies 300, 400, 500, and 600 discussed above, the motors 312, 412, 512 and 612 may run continuously whereby the transfer members 302, 402, 502 and 602 are continuously rotating. The speed of the transfer members 302, 402, 502 and 602 is at least as fast as the speed of the gear members 124 and 126 of the machine's feeding assembly 54, and preferably faster to speed up the exit of the cushioning pad 32. As for the pad-transferring device 700, the fluid motor or source 712 may be continuously supplying fluid whereby the jets 702 are continuously shooting fluid streams. Also, the intensity of the fluid stream is at least great enough to match the peripheral speed of the gear members 124 and 126, and preferably slightly greater. If the pad-transferring rate is greater than the converting rate, the pad-transferring device 300/400/500/600/700 may further serve as a "stretching" device to compensate for any longitudinal crimping losses experienced by the cushioning pad 32 during the converting process.

Figure 14:
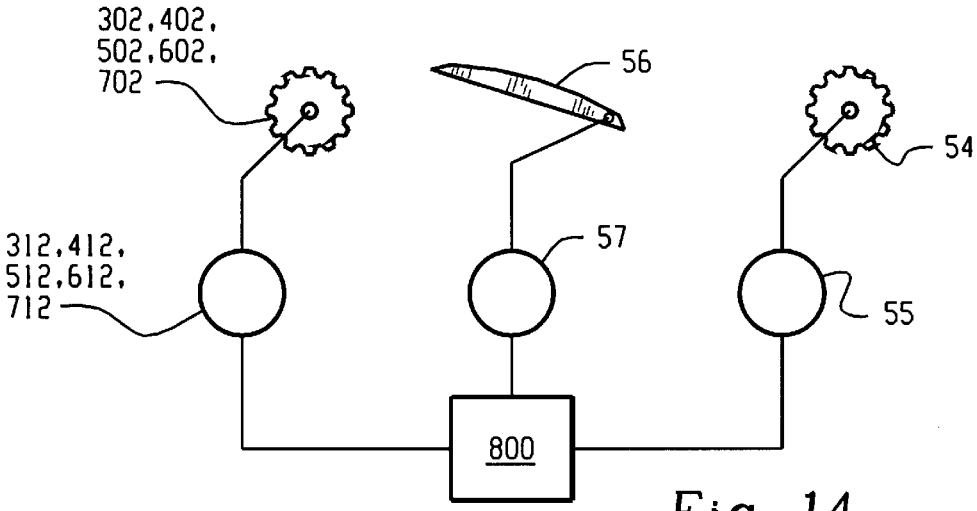
FIGS. 14–16 are schematic illustrations of control systems for a cushioning conversion machine which incorporates a pad-transferring device according to the present invention.

If the motor 312/412/512/612 and/or the fluid source 712 are constantly activated, there may be no need to coordinate the control of the pad-transferring device 300/400/500/600/700 with the other assemblies of the cushioning conversion machine 20. However, a controller 800 such as is shown in FIG. 14 may be provided if other control arrangements are desired. The controller 800 coordinates the activation/deactivation of the feed motor 55, the cut motor 57, and the pad-transfer motor 312/412/512/612 or fluid source 712. The controller 800 can control the pad-transfer motor to run all the time, to run only when the severing assembly 56 is not cutting (i.e., when the cutter motor 57 is not activated or its clutch is not engaged); to run only when the feeding assembly 54 is feeding (i.e., when the feed motor 55 is activated), or for a predetermined period of time after the severing assembly 56 has completed a cut.

Figure 15:
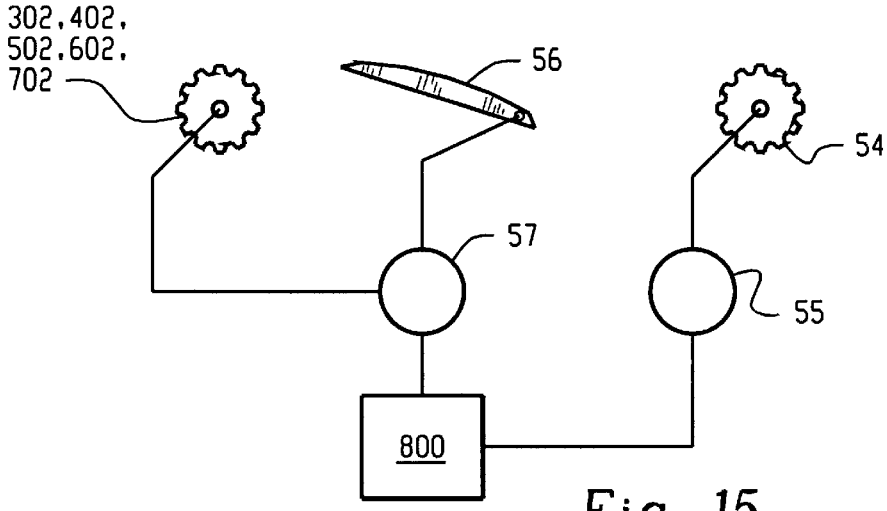

If the pad-transferring device 300/400/500/600/700 is to operate only when the severing assembly 56 is not cutting, it may be desirable for the pad-transferring device to share the motor 57 with the severing assembly 56, such as is shown in FIG. 15. In this control arrangement, a clutch system or other motion-distributing system would be used to alternatively supply the motor's rotational power to either the pad-transferring device 300/4001500/600/700 or the severing assembly 56.

Figure 16:
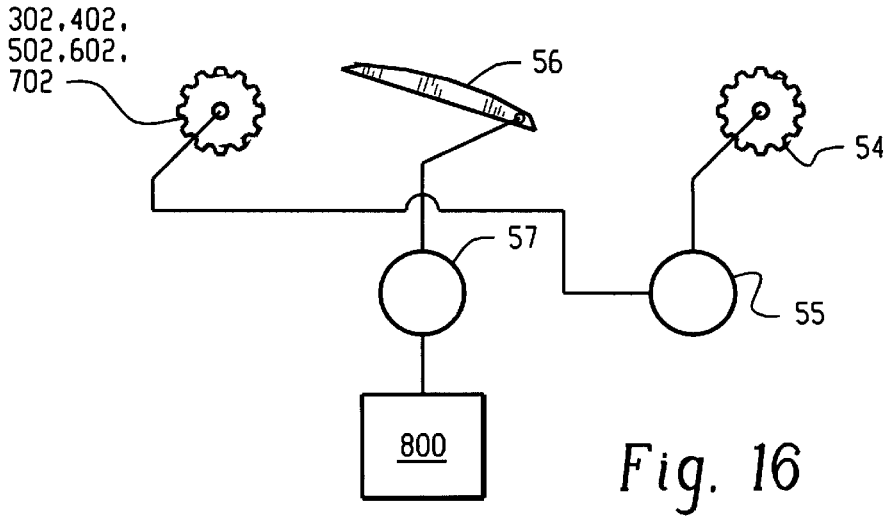

If the pad-transferring device 300/400/500/600/700 is to run only when the feeding assembly 54 is running, it may be desirable for the pad-transferring device to share a motor with the feeding assembly 54, such as is shown in FIG. 16. In this control arrangement, the motor 55 would power both the pad-transferring device and the feeding assembly 54 at the same time. Suitable gear trains could be used to provide for the desired speed ratios between the feeding assembly 54 and the pad-transferring device 300/400/500/600/700.

In some of the above-discussed control arrangements, it might further be desirable for the transfer members 302/402 or the transfer member 502 to be moved away from the cushioning pad when the transfer force is not being applied and then moved back towards the cushioning pad when the transfer force is to be applied. This would allow the strip 31 to move more freely during non-transfer periods. For example, in a control arrangement where pad-transferring occurs only after the cutting operation, the strip 31 would be allowed to move freely through the machine's exit until the cutting the operation occurs to create the subsequent cut section of cushioning product to be transferred. (In contrast, in a control arrangement where the pad-transferring device is always activated except during the cutting operation, it may be desirable for the transfer members 302/402/502/602 to remain in the transferring position to "hold" the strip during the cutting process.) In any event, this movement of the transfer members 302, 402, 502, or 602 could likewise be controlled by the controller 800. In addition, in pad-transferring devices 300, 400 or 600 which utilize two rotating members, it may be sufficient to rotatably drive only one and preferably the bottom rotating members 302, 402, or 602 and to permit the corresponding upper rotational member to rotate freely.

One may now appreciate the present invention provides a pad-transferring device which transfers a cushioning pad by applying a transferring force that is concentrated at the compressed connecting portion or other portion of the cushioning pad which does not form part of the pad's pillow-like portion(s). In this manner, there is no need to worry about the device deforming the pillow-like portions of the cushioning product.

Although the invention has been shown and described with respect to certain preferred embodiments, it is obvious that equivalent alternations and modifications will occur to others skilled in the art upon the reading and understanding of this specification. For example, a pad-transferring device according to the present invention may be incorporated into any cushioning conversion machine or method which falls within the scope of the claims. For example, the device may be incorporated into a cushioning conversion machine as set forth in U.S. Pat. Nos. 4,026,198; 4,085,622; 4,109,040; 4,237,776; 4,557,716; 4,650,456; 4,717,613; 4,750,896; 4,884,999; 4,968,291; 5,061,543 and 5,188,581. The present invention includes all such equivalent alterations and modifications, and is limited only by the scope of the following claims.

What is claimed is:

1. A cushioning conversion machine comprising: a converting assembly which converts a sheet-like stock material into a strip of dunnage having at least one pillow-like portion and a connecting portion; a severing assembly which severs the strip to form a cushioning pad having at least one pillow-like portion and a connecting portion; and a pad-transferring device which transfers the cushioning pad away from the severing assembly by applying a transferring force to the cushioning pad; wherein said transferring force is concentrated at the connecting portion of the cushioning pad, and wherein said pad-transferring device includes at least one driven rotating member which contacts substantially only the connecting portion of the cushioning pad when said transferring force is being applied.

2. A cushioning machine as set forth in claim 1 wherein the converting assembly converts the sheet-like stock material in such a manner that the connecting portion of the strip of dunnage is a central portion whereby the connecting portion of the cushioning product is a central portion.

3. A cushioning conversion machine as set forth in claim 1 wherein the converting assembly converts the sheet-like stock material in such a manner that the strip of dunnage has two pillow-like portions with the connecting portion therebetween.

4. A cushioning conversion machine as set forth in claim 3 wherein the converting assembly comprises a forming assembly which inwardly turns the lateral ends of the sheet-like stock material to form the two pillow-like portions and a gear assembly which connects the overlapped edges of the sheet-like stock material to form the connecting portion.

5. A cushioning conversion machine as set forth in claim 1 wherein the converting assembly converts the sheet-like stock material in such a manner that the connecting portion is a coined portion.

6. A cushioning conversion machine as set forth in claim 1 wherein the transferring force is at least great enough to move the cushioning pad at the same speed as the converting assembly is moving the strip of dunnage.

7. A cushioning conversion machine as set forth in claim 6 wherein the transferring force is greater than the force necessary to move the cushioning pad at the same speed as the converting assembly is moving the strip of dunnage whereby the cushioning pad will be transferred at a faster speed than it is converted.

8. A cushioning conversion machine as set forth in claim 1 wherein the pad-transferring device comprises a motor which supplies the transferring force.

9. A cushioning conversion machine as set forth in claim 1 wherein the converting assembly is powered by a motor and wherein the motor also supplies the transferring force to the pad-transferring device.

10. A cushioning conversion machine as set forth in claim 1 wherein the pad-transferring device further comprises a shaft on which the at least one rotating member is mounted and wherein the shaft is rotatably driven by a motor.

11. A cushioning conversion machine as set forth in claim 1, wherein the at least one rotating member has an axial dimension approximately equal to the width of the connecting portion of the cushioning pad and is positioned to contact only the connecting portion of the cushioning pad.

12. A cushioning conversion machine as set forth in claim 1, wherein said at least one rotating member is a gear-like member which engages the connecting portion.

13. A cushioning conversion machine as set forth in claim 12 wherein the at least one rotating member is movable towards the cushioning pad for when the cushioning pad is being transferred and away from the cushioning pad when the cushioning pad is not being transferred.

14. A cushioning conversion machine as set forth in claim 1, wherein said at least one rotating member is a wheel-like member having a generally smooth outer surface which engages the connecting portion.

15. A cushioning conversion machine as set forth in claim 14 wherein said wheel-like member includes at least one peripheral O-ring.

16. A cushioning conversion machine as set forth in claim 1 wherein said pad-transferring device includes a pair of transfer members which are situated to apply the transferring force to the top and bottom sides, respectively, of the connecting portion.

17. A cushioning conversion machine as set forth in claim 16 wherein said pair of transfer members are a pair of rotating members situated to contact the top and bottom surfaces, respectively, of the connecting portion.

18. A cushioning conversion machine as set forth in claim 17 wherein the rotating members meshingly engage the connected portion of the cushioning pad therebetween.

19. A cushioning conversion machine as set forth in claim 18 wherein the converting assembly includes a pair of rotating feed members and wherein the rotating members are of substantially the same size and shape as the rotating feed members.

20. A cushioning conversion machine as set forth in claim 19 wherein the rotating feed members are coining gears.

21. A cushioning conversion machine as set forth in claim 17 wherein the rotating members each include a plurality of radially extending flexible filaments which are positioned to engage only the connecting portion of the cushioning product.

22. A cushioning conversion machine as set forth in claim 1 wherein the pad-transferring device comprises a shelf on which the bottom of the cushioning pad rests and a rotating member which rotates to apply the transferring force to the cushioning pad.

23. A cushioning conversion machine comprising: a converting assembly which converts a sheet-like stock material into a strip of dunnage having at least one pillow-like portion and a connecting portion; a severing assembly which severs the strip to form a cushioning pad having at least one pillow-like portion and a connecting portion; and a pad-transferring device which transfers the cushioning pad away from the severing assembly by applying a transferring force to the cushioning pad; wherein said transferring force is concentrated at the connecting portion of the cushioning pad wherein the severing assembly is powered by a motor and wherein the motor also supplies the transferring force to the pad-transferring device.

24. A method comprising the steps of: converting a sheet-like stock material into a strip of dunnage having at least one pillow-like portion and a connecting portion; severing the leading end of the strip of dunnage to form a cushioning pad having at least one pillow-like portion and a connecting portion; applying a transferring force to the cushioning pad which is concentrated at the connecting portion of the cushioning pad wherein said applying step includes applying the transferring force to only the connecting portion of the cushioning pad.

25. A method as set forth in claim 24 wherein the converting step is performed in such a manner that the connecting portion of the strip of dunnage is a central portion whereby the severing step results in the connecting portion of the cushioning pad being a central portion.

26. A method as set forth in claim 24 wherein said converting step comprises converting the sheet-like stock material into the strip of dunnage in such a manner that the strip comprises two pillow-like portions with the connecting portion therebetween, whereby said severing step forms a cushioning pad having two pillow-like portions with the connecting portion therebetween.

27. A method as set forth in claim 24 wherein said step of applying a transferring force is performed at the same time as said converting step and said severing step.

28. A method as set forth in claim 24 wherein said step of applying a transferring force is performed only when the severing step is not being performed.

29. A method as set forth in claim 24 wherein said step of applying a transferring force is performed only when the converting step is being performed.

30. A method as set forth in claim 24 wherein said step of applying a transferring force is performed only for a predetermined period of time after the severing step.

* * * * *